US005410859A

United States Patent [19]

Kresak et al.

[11] Patent Number: 5,410,859

[45] Date of Patent: May 2, 1995

[54] APPARATUS FOR LOADING ARTICLES INTO A CONTAINER

[75] Inventors: Paul F. Kresak, Newmarket; Shanky Lau, Etobicoke, both of Canada

[73] Assignee: Husky Injection Molding Systems Ltd., Bolton, Canada

[21] Appl. No.: 158,703

[22] Filed: Nov. 29, 1993

[51] Int. Cl.[6] ..... B65B 35/30

[52] U.S. Cl. ..... 53/537; 53/244; 53/247; 53/260; 53/542; 53/566

[58] Field of Search ..... 53/543, 244, 251, 250, 53/249, 572, 537, 260, 247, 258, 538, 542, 566; 414/404, 417

[56] References Cited

U.S. PATENT DOCUMENTS

| | | | |
|---|---|---|---|
| 1,302,893 | 5/1919 | Bruckman | 53/537 |
| 1,992,166 | 2/1935 | Beauclerk | 53/260 |
| 3,067,556 | 12/1962 | Neer | 53/566 |
| 3,490,195 | 6/1967 | Abramson | 53/572 |
| 5,136,826 | 8/1992 | Carson et al. . | |
| 5,212,930 | 5/1993 | Raudat . | |
| 5,212,932 | 5/1993 | Raudat et al. . | |

FOREIGN PATENT DOCUMENTS

| | | |
|---|---|---|
| 0124951 | 11/1984 | European Pat. Off. . |
| 3741257 | 6/1989 | Germany . |

*Primary Examiner*—John Sipos
*Assistant Examiner*—Gene Kim
*Attorney, Agent, or Firm*—Bachman & LaPointe

[57] ABSTRACT

A predetermined number of articles, as open ended, nested hollow articles, are packed in a container by an apparatus including a first holding means for said articles including a first retaining means, as a gate means, adjacent the end portion thereof. Means are provided for moving the first holding means with nested articles thereon into an adjacent carton, means are provided for moving the gate means into the open position to permit the articles to be removed from the first holding means, and a second retaining means is provided for holding the articles in the carton while removing the first holding means.

13 Claims, 6 Drawing Sheets

APPARATUS FOR LOADING ARTICLES INTO A CONTAINER

BACKGROUND OF THE INVENTION

The present invention involves packing articles, as nested stacks of containers, generally plastic containers, preferably in a vertical orientation with the open end down. The stacks are packed into packing cartons. Typically, this is a time consuming operation which is performed manually after articles such as cups, margarine or yogurt tubs or similar containers have been stacked by any one of a number of known methods.

An automated apparatus for packaging stacked cups is described in German Patent No. 37 41 257, published Jun. 15, 1989. This patent discloses a gripping apparatus for picking up, transporting and horizontally placing a stack of nested cup shaped articles into a packaging container. A long curved retainer rotates about the central axis of the stack of cups to trap the stack against a flat fixed stop. This device places a stack in a horizontal orientation in the packaging carton. This means that removal of individual cups from the carton would be awkward at best. Generally, an entire stack must be removed in order to remove an individual cup. In addition, horizontally packed stacks tend to separate during handling and shipping.

U.S. Pat. No. 5,136,826 shows an apparatus for preparing an array of stacked articles for insertion into a packaging carton. In operation, the open end of the carton is manually placed over the array. Then, the articles and carton are manually or semi-automatically inverted and the carton is sealed. This represents a time consuming and inconvenient operation involving a great deal of hand labor.

U.S. Pat. No. 5,212,390 describes an apparatus for loading tall, upright containers into packing cases. This apparatus consists of two conveyors, one above the other, and a flight bar conveyor with an inclined path between the other two conveyors. The upright containers are moved in parallel in-line columns along the upper feed conveyor until they are gripped by depending pegs. The pegs carry and guide the containers down into the packing cases along the inclined path. Although this apparatus can pack tall containers vertically into a packing case, it could not be used to vertically pack stacks of cups or tubs or the like since only a portion of the height of the articles to be packed could be grasped. The remainder of the stack would separate.

U.S. Pat. No. 5,212,932 discloses an apparatus for vertically loading articles into a packaging carton so that the articles are upright in the carton. In accordance with the disclosed apparatus, an array of articles to be packaged is positioned above a carrier. The carrier has finger assemblies for receiving, holding and transporting the articles to the carton. The fingers can be opened to release the articles into the container. The apparatus requires a considerable amount of space between and around adjacent articles or stacks to allow the fingers to release the articles. This means that the articles or stacks cannot be packaged very densely resulting in wasted space and/or loose articles in the package.

European Patent Application 0 124 951, published Nov. 14, 1984, discloses a stacked article packaging apparatus wherein the stacks are allowed to drop on their sides into an open box so that they are lying down in the box. A predetermined number of articles are stacked vertically onto a rotatable carrier with a tilting table which then drops the stack onto a conveyor. This apparatus is not capable of packaging the stacks vertically and allows them to drop twice; once from the carrier and again from the conveyor into the carton. Dropping the stack is a tenuous operation and could result in some of the article separating from the stack and causing a jam.

Accordingly, it is a principal object of the present invention to provide an apparatus for packing articles, as elongated, non-rigid articles, or flexible articles, or nested stacks of containers.

It is a particular object of the present invention to provide an apparatus as aforesaid for packing nested stacks of containers in a vertical orientation, with if desired the open end down, which is efficient and convenient to do and which is not prone to separation of the nested stacks.

Further objects and advantages of the present invention will appear hereinbelow.

SUMMARY OF THE INVENTION

In accordance with the present invention, the foregoing objects and advantages are readily obtained.

The apparatus of the present invention comprises: a first holding means for holding a predetermined number of articles, as open ended, nested hollow articles, generally a supporting and/or cradling first holding means for holding a predetermined number of stacked open ended articles, said first holding means having an end portion; a first retaining means, as a gate, adjacent the end portion of the first holding means, said first retaining means having a closed position and an open position operative respectively to secure said articles on said first holding means and to enable removal of said articles from said first holding means; a second holding means, generally an open carton with cavity therein or the like to be packed, having an open end to be filled with the articles, spaced from and generally adjacent the first holding means, with the open end thereof facing the articles; means for moving the first holding means into and out of the second holding means, with the first holding means, with articles thereon and with first retaining means in the closed position, moved into the second holding means; means for moving the first retaining means into the open position to permit the articles to be removed from the first holding means; a second retaining means in movable spaced relationship to the first holding means for holding the articles in the second holding means while moving the first holding means away from the second holding means, thereby transferring the articles from the first holding means to the second holding means. In accordance with the apparatus of the present invention, desirably the first holding means may hold more than one row of nested articles.

The second holding means or packing carton has a base and side portions thereof perpendicular thereto, wherein the first holding means is movable in a first direction parallel to the side portions of the carton to place the articles in the carton, and in a second direction perpendicular to the side portions thereof to orient said first holding means with respect to said carton.

The apparatus desirably includes a tilting table for holding said second holding means, and the entire apparatus is preferably oriented from 10° to 60° to the horizontal, generally around 30°, in order to minimize the likelihood of article separation.

The first holding means is preferably supported by trolley which travels along a transverse rail. End stops are preferably provided on the rail in order to limit travel of the trolley and first holding means.

The apparatus of the present invention readily packs nested stacks of open ended containers in a vertical orientation with respect to the base of the packing carton with the open end of the containers down pointing towards the base.

The apparatus of the present invention readily overcomes the disadvantages known heretofore. The articles are readily stacked vertically in a packing carton. Vertical stacking in a carton is highly desirable in many instances in order to facilitate unpacking. Vertically stacked arrays retain their spatial orientation and relationship in the carton much easier than horizontally packed stacks. Further, a vertically oriented stack of articles is kept positively nested by gravity. Horizontally packed stacks or sleeves tend to become loose in the carton during handling and transportation. Further, horizontally nested articles such as cups or tubs often must be sleeved in plastic to keep them from separating in the carton. Vertically packed stacks, however, generally do not require plastic sleeves to keep them nested. This is particularly important for shallow articles. Shallow articles, such as margarine tubs, in particular are prone to separation when nested stacks thereof are packed horizontally. Moreover, they are also much more difficult to handle horizontally. Further, the apparatus of the present invention does not involve free dropping stacks of nested articles. Free dropping causes the stack to become loose with some of the articles possibly separating from the stack or becoming damaged. Still further, the apparatus of the present invention permits one to optimize packing density, which is highly desirable.

Further advantages of the present invention will appear in the ensuing disclosure.

BRIEF DESCRIPTION OF THE DRAWINGS

The present invention will be more readily understandable from a consideration of the following illustrative drawings in which.

DETAILED DESCRIPTION OF PREFERRED EMBODIMENTS

Figure 1:
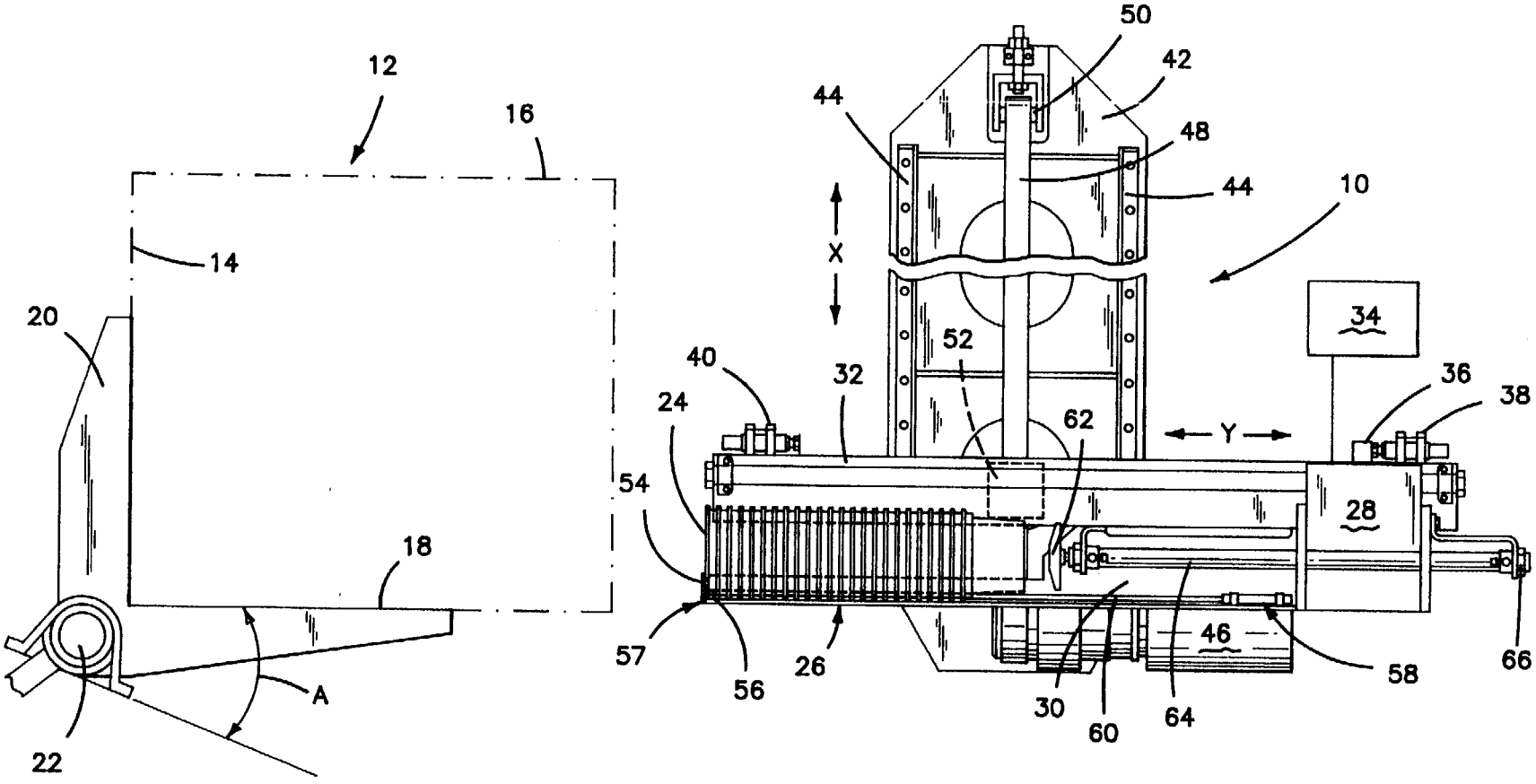
FIG. 1 is a side view of the apparatus of the present invention with the nested articles ready to be inserted in a packing container.
Figure 2:
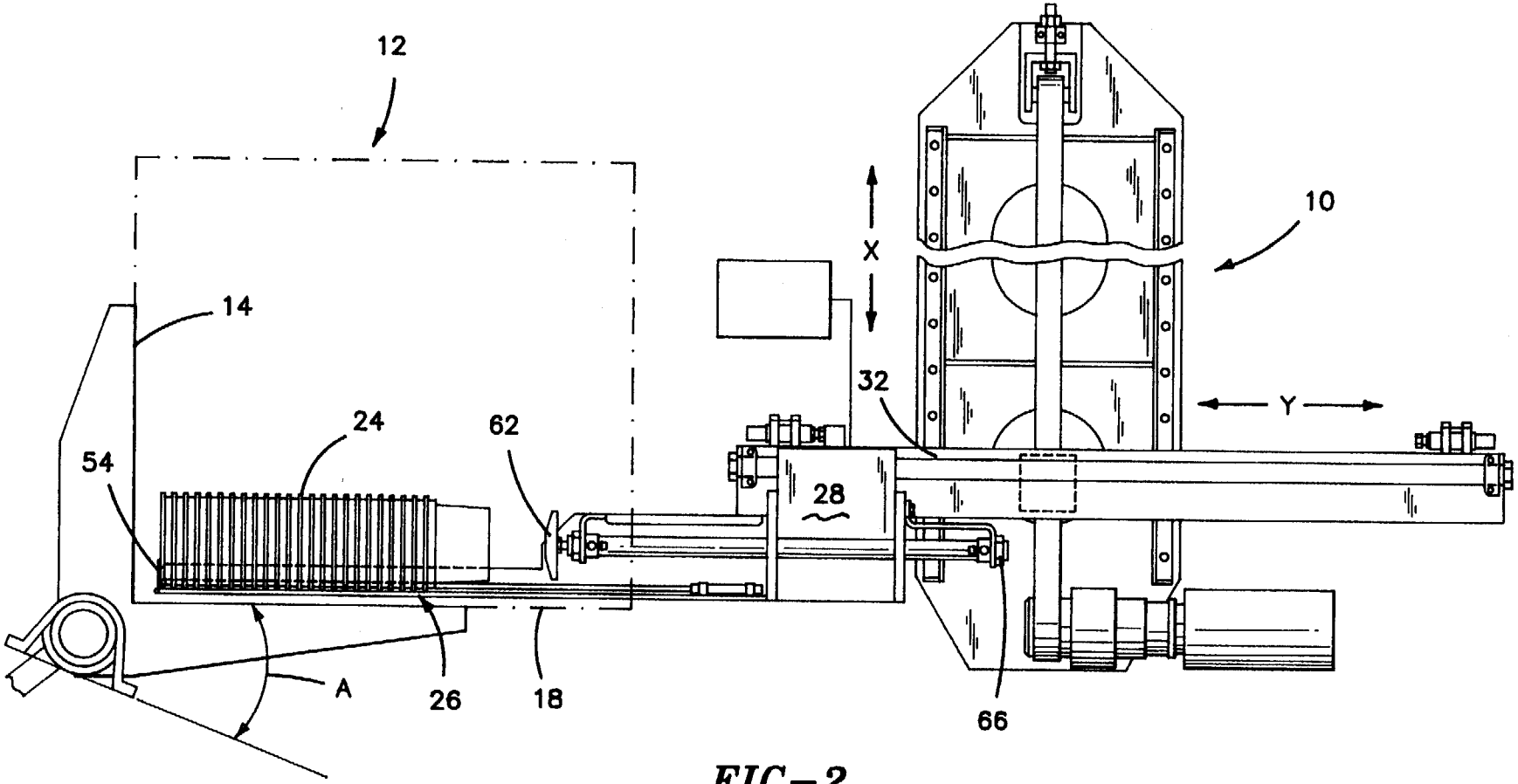
FIG. 2 is a side view similar to FIG. 1 with the nested articles and first holding means inserted into the packing container.
Figure 3:
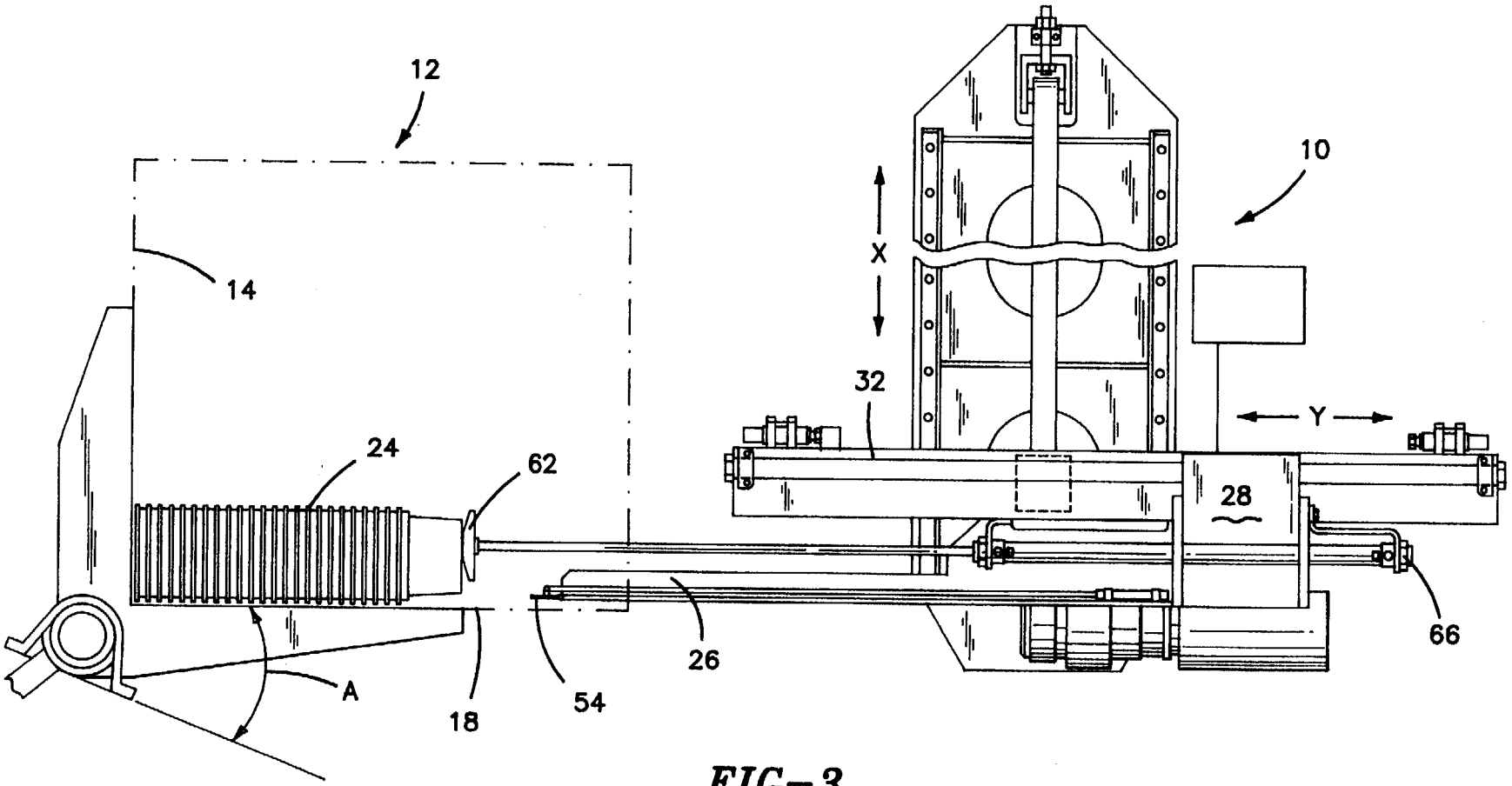
FIG. 3 is a view similar to FIG. 1 showing removal of the first holding means from the nested articles.
Figure 4:
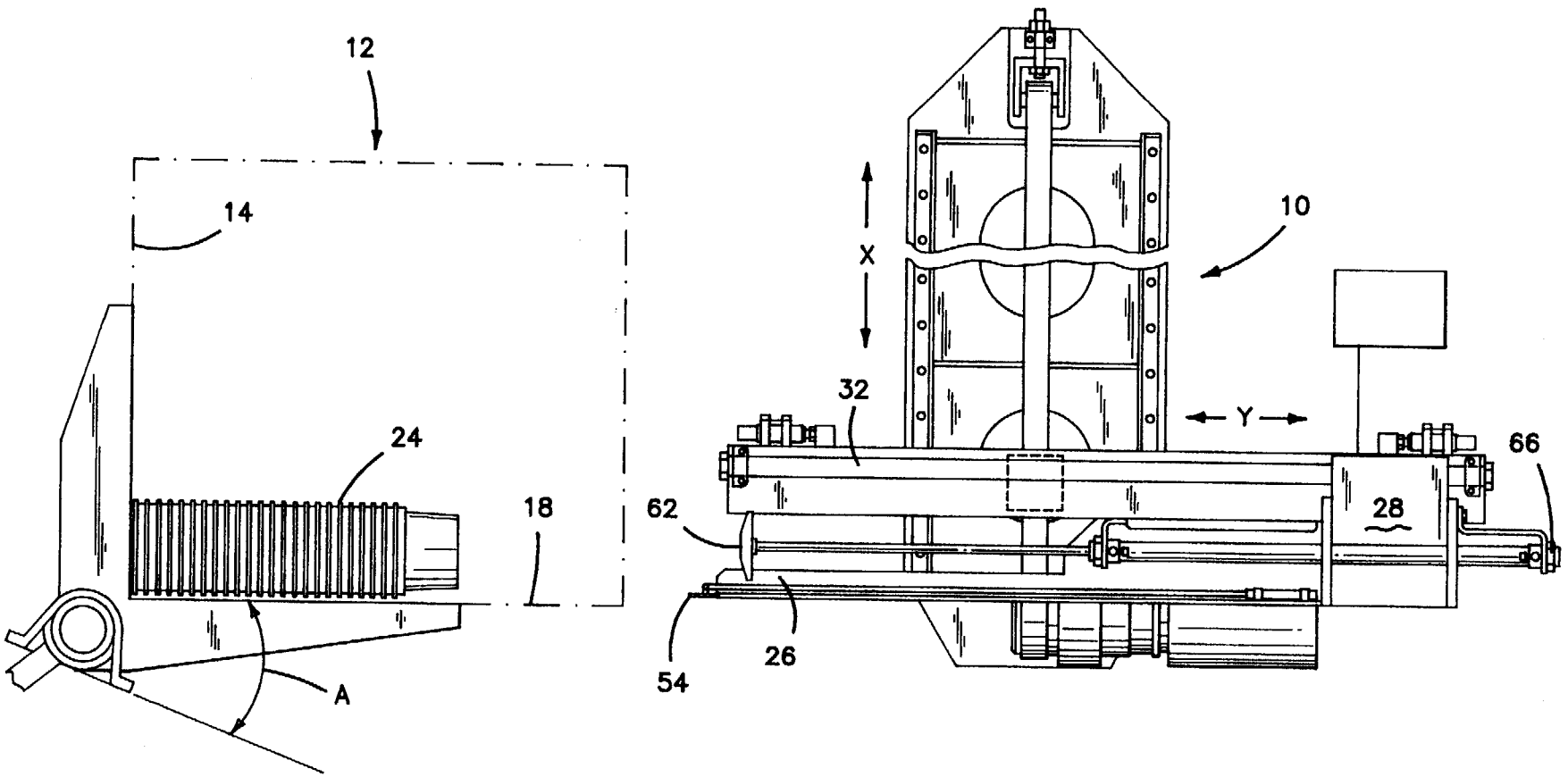
FIG. 4 is a view similar to FIG. 1 showing the nested articles positioned in the container.

FIG. 1 shows the packing apparatus 10 and the carton to be filled 12 spaced therefrom and adjacent thereto. FIGS. 2, 3 and 4 show subsequent stages of operation. The carton 12 and packing apparatus should be inclined to the horizontal along angle A from 10°-60° and generally at about 30°. The angle of incline can be adjusted to suit the particular application depending on the article being packed. This angle insures that each row of stacks stays nested and tends to lean towards the lower side of the carton to insure dense packing and consistent layering of the rows.

Carton 12 (shown in phantom) has a base 14 and side portions 16 and 18 perpendicular to the base. Carton 12 is supported on tilting table 20 which pivots about axis 22. Tilting table 20 can be positioned so that side 18 of carton 12 is at the desired angle A, e.g., about 30° to the horizontal. If desired, carton 12 may have a plastic liner to protect the articles.

As shown in FIG. 1, a predetermined number of nested, open ended, hollow articles 24, such as plastic cups or margarine tubs, are placed in first supporting holding means, as contoured holder 26, by any desired means. While it is preferred to use nested articles as shown, it should be understood that the present invention effectively may employ at least one flexible elongated body and does not require the nested configuration. Holder 26 for holding articles 24 is connected to and supported by trolley 28 as via holder extension 30. The holder may desirably be a supporting and/or cradling holder, as a contoured holder. Trolley 28 travels in direction Y along transverse rail 32 and therefore holder 26 travels in the same direction. Motive means 34 for trolley 28 are shown schematically in FIG. 1, but can be in any desired form, such as a servo motor or a pneumatic cylinder. Trolley 28 includes an extension or flange member 36 that contacts end stops 38, 40 on essentially horizontal or transverse rail 32 to limit the travel of the trolley 28 and contoured holder 26. Rail 32 also travels in direction X perpendicular to direction Y on frame 42 on essentially vertical rails 44. Frame 42 is oriented as tilting table 20 so that the packing apparatus 10 is oriented as carton 12. Movement of rail 32 in the direction X is caused by motor 46 driving a synchronous belt 48 which travels over pulley 50 and is fixed to rail 32 with clamp 52 (shown in phantom).

Figure 6:
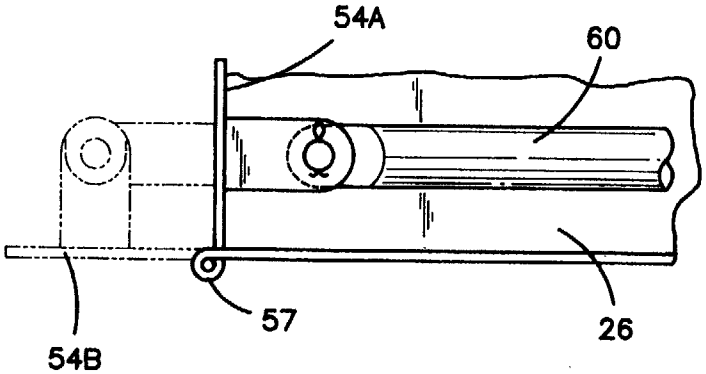
FIGS. 6 and 7 are side and top views respectively of the gate means.
Figure 7:
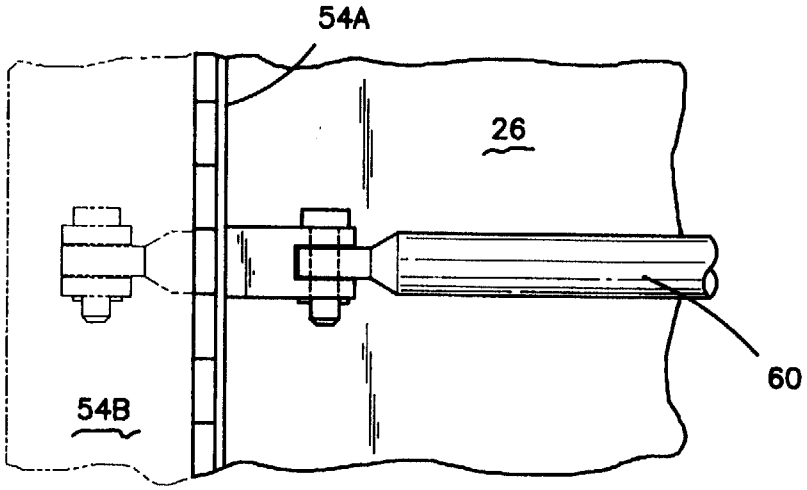

First, retaining means, as gate 54 or an elastic member or the like, is positioned on the end portion 56 of contoured holder 32 and pivots about hinge 57 to move between a closed position 54A shown in FIGS. 6–7 and illustrated in FIGS. 1–2, and an open or release position 54B essentially perpendicular to the closed position shown in phantom in FIGS. 6–7 and illustrated in FIGS. 3–4. Gate 54 may be operated by any desired means, as by motive means 58, in this case a small pneumatic cylinder, but other means may be used, such as a solenoid or a mechanical drive. Cylinder 58 pushes or pulls on rod 60 (see FIGS. 6–7) to actuate gate 54 from the closed to open to closed positions. The purpose of the gate or first retaining means is to prevent the stack of articles from sliding down the contoured holder 26 until the apparatus has reached the release position in carton 12. Naturally, other appropriate gate designs may be used.

Second retaining means, as retainer or retainers 62 is fixed to the end of rod 64 of cylinder 66, with rod 64 running parallel to rail 32. As indicated above, all components are mounted at angle A to the horizontal (e.g., approximately 30°). Transverse rail 32 and holder 26 are approximately parallel to side 18 of carton 12 while the carton is being stuffed with stacked articles.

Figure 5:
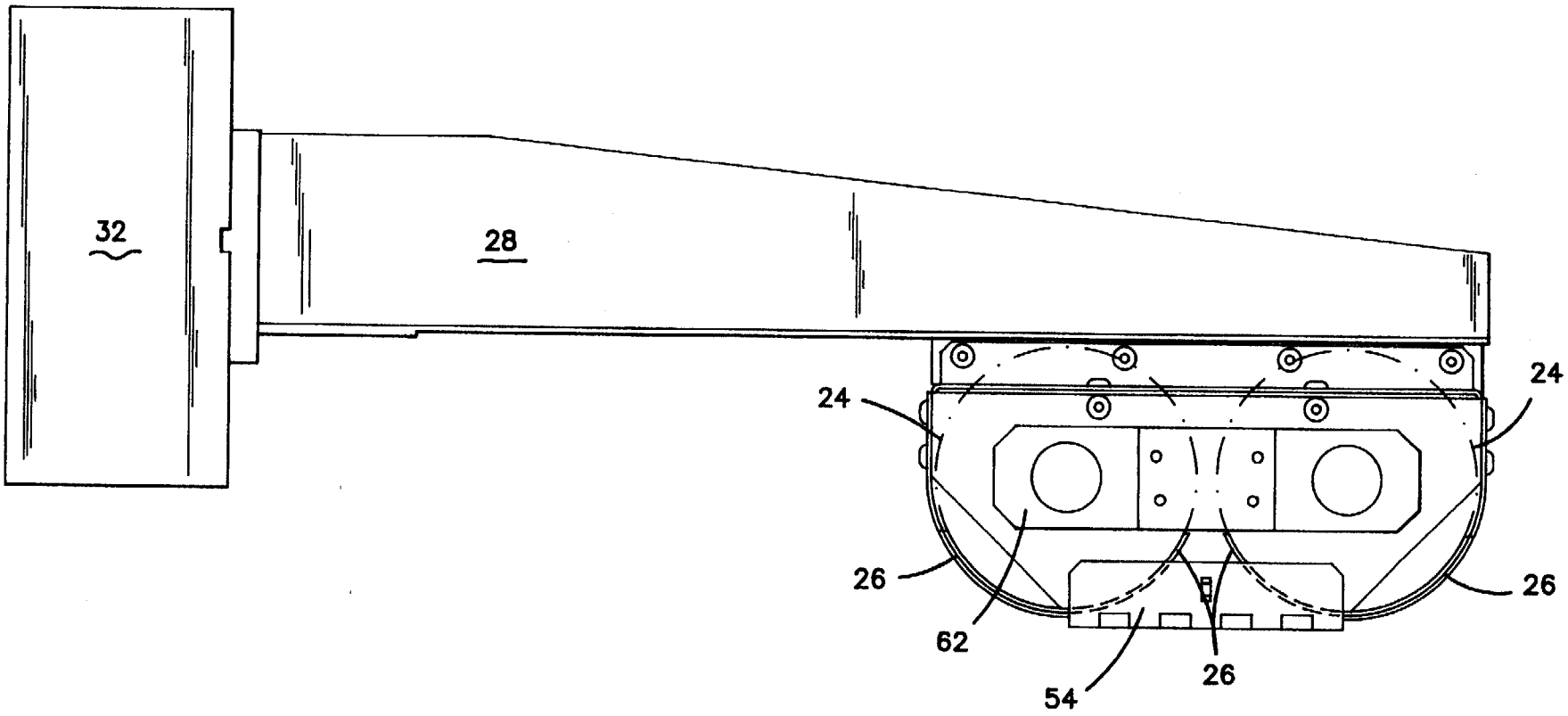
FIG. 5 is a front view of the first holding means and retainer means.

FIG. 5 shows an end view of two contoured holders 26 for receiving two stacks of nested articles 24 (shown in phantom) and with gate 54 in the closed position. Retainer 62 is also shown for engaging both stacks of nested containers 24 in both holders. Naturally, more than two holders 26 could also be used to match the number of stacks in a layer as desired.

In operation, an empty carton 12 is placed on the tilting table 20 either manually or by some other well known automated means. The table is then tilted until the sides 16 and 18 of the carton 12 are for example approximately 30° from the horizontal. When in this position, the sides of the carton 12 are parallel with the transverse rail 32 as shown in FIG. 1. The carton 12 is also aligned centrally with the stacks of articles 24 in contoured holders 26. In this case, two stacks are shown, but the carton 12 and contoured holder 26 could be adapted to handle one or more stacks without any major changes to the apparatus. The holders 26 and gate 54 can be considered tooling that can be adapted to accommodate different packing requirements.

In FIG. 1, the apparatus is shown in its initial position with a set of stacks of articles 24 placed in the contoured holder 26 by any desired means and gate 54 in the closed position. The articles are securely retained by the contoured holder 26 and gate 54. Retainer 62 may be used to urge the stack against the gate to prevent movement during transfer. The first charge of stacked articles will be placed on the lowest side 18 of carton 12. Transverse rail 32 is therefore positioned so that the bottom of contoured holder 26 is spaced from lower side 18 in the Y direction and just above lowest side 18 in the X direction.

At the beginning of the packing sequence, trolley 28 is moved to the left along direction Y by motive means 34. Since the stack is inclined to the horizontal, as by for example 30°, the articles remain nested during the motion and can be retained by retainer 62. The bottom of contoured holder or holders 26 travels just above the inside of the lowest side 18 of carton 12. Trolley 28 moves until stop 40 is contacted by extension 36 of the trolley 28. FIG. 2 shows this condition. The end of contoured holder 26 stops far enough away from the base 14 of the carton 12 so that gate 54 can rotate to an open position without interference.

Once the transverse trolley 28 has reached its end point, then pneumatic cylinder 58 is energized to push rod 60 and rotate gate 54 about pivot 57 to allow the stack of articles 24 to slide the very short distance to the bottom of the carton 12 as shown in FIGS. 3–4, with the aid of retainer 62 if desired. Cylinder 66 is energized if desired to move retainer 62 against the top of the stack of articles and urge them into the box so that retainer 62 may act as a pusher means. Trolley 28 with contoured holder 26 is then moved out of carton 12 along the same path as they entered as shown in FIG. 3. While they are moving out, cylinder 66 continues to apply a force through retainer 62 to the top of the stack.

Retainer or retainers 62 remain stationary relative to carton 12 and article stack 24 during the extension of cylinder 66 and most of the retraction of transverse trolley 28. This insures that none of the articles of the stack is disengaged from the rest of the stack during withdrawal of contoured holder 26. FIG. 3 shows cylinder 66 fully extended during the return of transverse trolley 28 to its starting position, and FIG. 4 shows trolley 28 and holder 26 fully retracted. The apparatus will be ready to receive another charge of stacked articles once cylinder 66 is retracted.

For subsequent insertions, transverse rail 32 moves in the X direction to a position which aligns the bottom of contoured holders 26 immediately above the just inserted row of stacks. The sequence is repeated until the carton 12 is full. The apparatus allows carton space to be maximized since very little space is required for the apparatus to carry and deposit the articles in the box. Alternatively, instead of moving transverse rail 32 in the X direction, one can move tilting table 20 in the X direction, thereby accomplishing the same goal.

The sequence described above requires loading the stacks into contoured holder or holders 26 which are located at different positions for each insertion depending on how many layers have already been "stuffed". In other embodiments of the invention, the articles are deposited into the contoured holders 26 at the same place, i.e, either the uppermost or lowermost position (or some intermediate position) for transverse rail 32. The assembly then moves to the appropriate level to insert the stacks into the carton. This simplifies the apparatus that delivers the stacks to this invention and is the preferred embodiment.

The timing and sequence of all motions is under the direction of a controller that is integrated with the rest of the injection molding system by means well known in the art. However, the apparatus could be operated independently by its own controller as well if required.

The placing of empty cartons onto the tilting table and the subsequent removal of full cartons could be automated by any desired means to further reduce labor requirements.

Advantages of the present invention include secure holding of the stacks while being automatically inserted in a vertical orientation, with if desired, the open end of the articles facing down. A gate on the end of the holder prevents the parts from sliding off during insertion, and a retainer keeps the articles nested while the holder is withdrawn.

Figure 8:
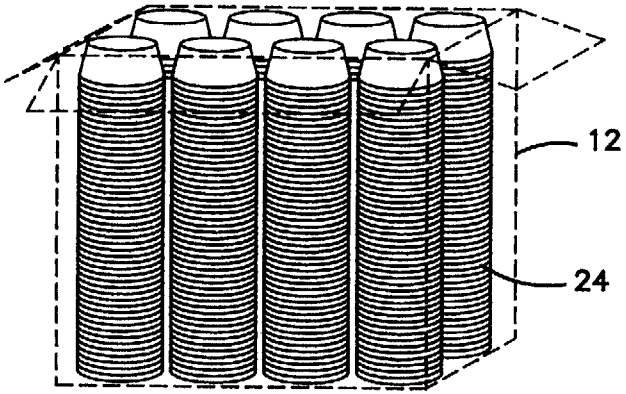
FIG. 8 is a side view of a packed container.

FIG. 8 shows carton 12 (in phantom) packed with stacks of articles 24 with open end down.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for transferring articles into a holding means which comprises:

a first holding means oriented at an angle from the horizontal for holding a predetermined number of articles, said first holding means having an end portion;

a first retaining means mounted on said first holding means and adjacent the end portion of the first holding means having a closed position to secure said articles on the first holding means and an open position to enable removal of the articles from the first holding means;

a second holding means oriented at an angle from the horizontal having an open end to be filled with the articles spaced from the first holding means, with the open end facing the articles;

means for moving the first holding means into and out of the second holding means, wherein said means for moving the first holding means is operative to move the first holding means into the second holding means with the articles thereon and with the first retaining means in the closed position; and a second retaining means in movable spaced relationship to the first holding means for holding the articles in the second holding means while moving the first holding means away from the second holding means means to move said first retaining means to the open and closed positions independently of movement of said articles on the first holding means.

2. Apparatus according to claim 1 wherein the first holding means is for holding a predetermined number of open ended, nested hollow articles.

3. Apparatus according to claim 2 wherein the first retaining means is a gate.

4. Apparatus according to claim 3 wherein the second holding means is spaced from and adjacent the first holding means.

5. Apparatus according to claim 4 wherein the first holding means is a contoured holder.

6. Apparatus according to claim 1 wherein the first holding means holds more than one row of nested articles.

7. An apparatus for transferring articles into a holding means which comprises:

a first holding means oriented at an angle from the horizontal for holding a predetermined number of articles, said first holding means having an end portion;

a first retaining means adjacent the end portion of the first holding means having a closed position to secure said articles on the first holding means and an open position to enable removal of the articles from the first holding means;

a second holding means oriented at an angle from the horizontal having an open end to be filled with the articles spaced from the first holding means, with the open end facing the articles;

means for moving the first holding means into and out of the second holding means,wherein said means for moving the first holding means is operative to move the first holding means into the second holding means with the articles thereon and with the first retaining means in the closed position;

a second retaining means in movable spaced relationship to the first holding means for holding the articles in the second holding means while moving the first holding means away from the second holding means; and wherein the second holding means has a base and side portions perpendicular thereto and wherein the means for moving the first holding means moves same in a first direction parallel to the side portions of the second holding means to place the articles in the second holding means, and in a second direction perpendicular to the side portions to orient the first holding means with respect to the second holding means.

8. Apparatus according to claim 7 including a tilting table for holding the second holding means.

9. Apparatus according to claim 8 wherein said first and second holding means are oriented 10°–60° from the horizontal.

10. Apparatus according to claim 1 wherein the first holding means is supported by a trolley which travels along a transverse rail.

11. Apparatus according to claim 1 including end stops on the rail to limit travel of the trolley and first holding means.

12. Apparatus according to claim 4 wherein the first holding means is a supporting and cradling holding means.

13. Apparatus according to claim 7 including means for moving the first holding means in a direction transverse to the side portions of said second holding means.

* * * * *

UNITED STATES PATENT AND TRADEMARK OFFICE

CERTIFICATE OF CORRECTION

PATENT NO. : 5,410,859

DATED : May 2, 1995

INVENTOR(S) : Paul F. Kresak et al.

It is certified that error appears in the above-identified patent and that said Letters Patent is hereby corrected as shown below:

In Column 7, claim 1, line 5, a new paragraph should start after "means" (first occurrence); and In Column 8, claim 11, line 29, "claim 1" should read --claim 10--.

Signed and Sealed this

Fifteenth Day of August, 1995

*Attest:*

Bruce Lehman

BRUCE LEHMAN

*Attesting Officer*

*Commissioner of Patents and Trademarks*